United States Patent [19]

Weatherby

[11] Patent Number: 4,761,977

[45] Date of Patent: Aug. 9, 1988

[54] DUAL FUNCTION LOCK/LATCH DEVICE

[75] Inventor: Robert G. Weatherby, Long Boat Key, Fla.

[73] Assignee: Sarasota Quality Products, Inc., Sarasota, Fla.

[21] Appl. No.: 145,135

[22] Filed: Jan. 19, 1988

[51] Int. Cl.[4] ..... E05B 29/02

[52] U.S. Cl. ..... 70/493; 70/377

[58] Field of Search ..... 70/364 R, 376, 377, 70/372, 364 A, 422

[56] References Cited

U.S. PATENT DOCUMENTS

| | | | |
|---|---|---|---|
| 1,747,380 | 2/1930 | Norviel | 70/364 R |
| 2,036,764 | 4/1936 | Lowe | 70/364 R |
| 2,182,307 | 12/1939 | Behnke | 70/364 R |
| 2,585,643 | 2/1952 | Feldmann | 70/364 R |

*Primary Examiner*—Robert L. Wolfe

*Attorney, Agent, or Firm*—A. W. Fisher, III

[57] ABSTRACT

A dual function lock/latch device selectively operable in a latch configuration or lock configuration comprising an outer housing having a bore formed therethrough including a lock spline and sleeve actuator spline, an inner member having a keyway and cam lock-/latch member formed on the outer and inner end portions thereof rotatable between a lock/latch position and an unlock/unlatch position disposed within the bore with a set of sleeve actuator tumblers and a set of locking tumblers disposed longitudinally along the periphery thereof movable from an extended and a retracted position by a key inserted into the keyway, and an intermediate sleeve disposed between the inner member and outer housing including a sleeve actuator slot and a lock slot formed therethrough such that when in the lock configuration and lock/latch position the lock tumblers extend through the lock slot into the lock spline to lock the inner member relative to the outer housing to lock the dual function lock/latch device in the lock/latch position, that when in the lock configuration the insertion of the key into the keyway retracts the set of sleeve actuator tumblers and set of lock tumblers to permit rotation of the inner member from the lock-/latch position to the unlock/unlatch position and that when in the latch configuration the set of sleeve actuator tumblers extend through the sleeve actuator slot to permit rotation of the inner member and intermediate sleeve between the lock/latch position and unlock/unlatch position.

16 Claims, 3 Drawing Sheets

DUAL FUNCTION LOCK/LATCH DEVICE

BACKGROUND OF THE INVENTION

1. Field of the Invention

A dual function lock/latch device selectively operable in a latch configuration or lock configuration to permit use as a latch or lock.

2. Description of the Prior Art

U.S. Pat. No. 3,875,773 discloses is a lock comprising a housing including a primary spline, secondary spline and trapping spline formed on the inner surface thereof and a plug including a keyway rotatably retained in the housing. A primary tumbler projects from the plug to interact with the primary spline to selectively retain the lock in an unlocked position and to interact with the secondary spline to selectively retain the lock in a locked position. A trapping tumbler projects from the plug to selectively retain the plug in the locked position by interacting therewith.

U.S. Pat. No. 1,141,463 shows a cylinder lock comprising a casing having a plug including a keyway rotatably disposed therein. A plurality of keys are provided to rotate the plug. A first cam including a key slot is fixedly connected to the plug. A second cam carrier by and rotating with the first cam is movable between at least three positions relative thereto. Means normally hold the second cam in one of the positions. The second cam including at least two spaced abutments is normally aligned with the key slot arranged to engage several of the keys such that the second cam is movable into the second and third positions.

U.S. Pat. No. 1,334,292 discloses a lock comprising a shell having locking pins adapted to be retired therein. A keyway member is rotatably mounted in the shell having plungers adapted to retire the locking pins when aligned therewith and engaged by a key and an auxiliary means to permit axial movement of the plungers by the key when the plungers and locking pins are placed out of alignment subsequent to a rotative movement of the keyway member. The auxiliary means consisting of a series of pins disposed at an inclination relative to the locking pins.

Additional examples of the prior art are shown in U.S. Pat. Nos. 1,207,123; 1,233,806; 1,608,080 and 2,754,673.

SUMMARY OF THE INVENTION

The present invention relates to a dual function lock/latch device comprising an outer housing, intermediate sleeve and inner member selectively operable in a latch configuration or lock configuration.

The outer housing comprises a body having a bore formed therethrough. A lock spline and a sleeve actuator spline are formed longitudinally on the inner periphery of the bore.

The intermediate sleeve comprises a hollow substantially cylindrical body including lock slot and a sleeve actuator slot formed therethrough.

The inner member comprises an inner body having a set of sleeve actuator tumblers and set of lock tumblers retractably disposed longitudinally along the periphery thereof. A keyway and cam lock/latch member are formed on opposite ends of the inner member.

In use, the dual function lock/latch device may be installed in any application suitable to a connection tumbler lock. The dual function lock/latch device is mounted to a door, hatch or lid by a mounting plate such that the cam lock/latch member can engage a stationary element to selectively latch or lock the door or lid.

When in the lock configuration, the inner member is locked or secured to the outer housing in the lock/latch position by the lock tumblers extending through the lock slot into the lock spline. When the proper key is inserted into the keyway, the inner member may be rotated relative to the outer housing to the latch/unlock position. At least one sleeve actuator detent and one corresponding sleeve detent tab are formed in the outer housing and intermediate sleeve respectively to cooperatively prevent rotation of the intermediate sleeve relative to the outer housing when the key is inserted in the keyway. When the key is removed in the unlock/unlatch position, the sleeve actuator tumblers extend through the sleeve actuator slot, while the lock tumblers engage the inner surface of the intermediate sleeve to prevent entry into the lock spline. The inner member and intermediate sleeve may then be rotated between lock/latch position and unlock/unlatch position. The user may thus secure the door, hatch or lid from accidentally opening without the use of the key.

When in the latch configuration and unlock/unlatch position, the user may insert the key and rotate the inner member to lock/latch position. Upon removal of the key, the dual function lock/latch device is again in the lock configuration in the lock/latch position.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
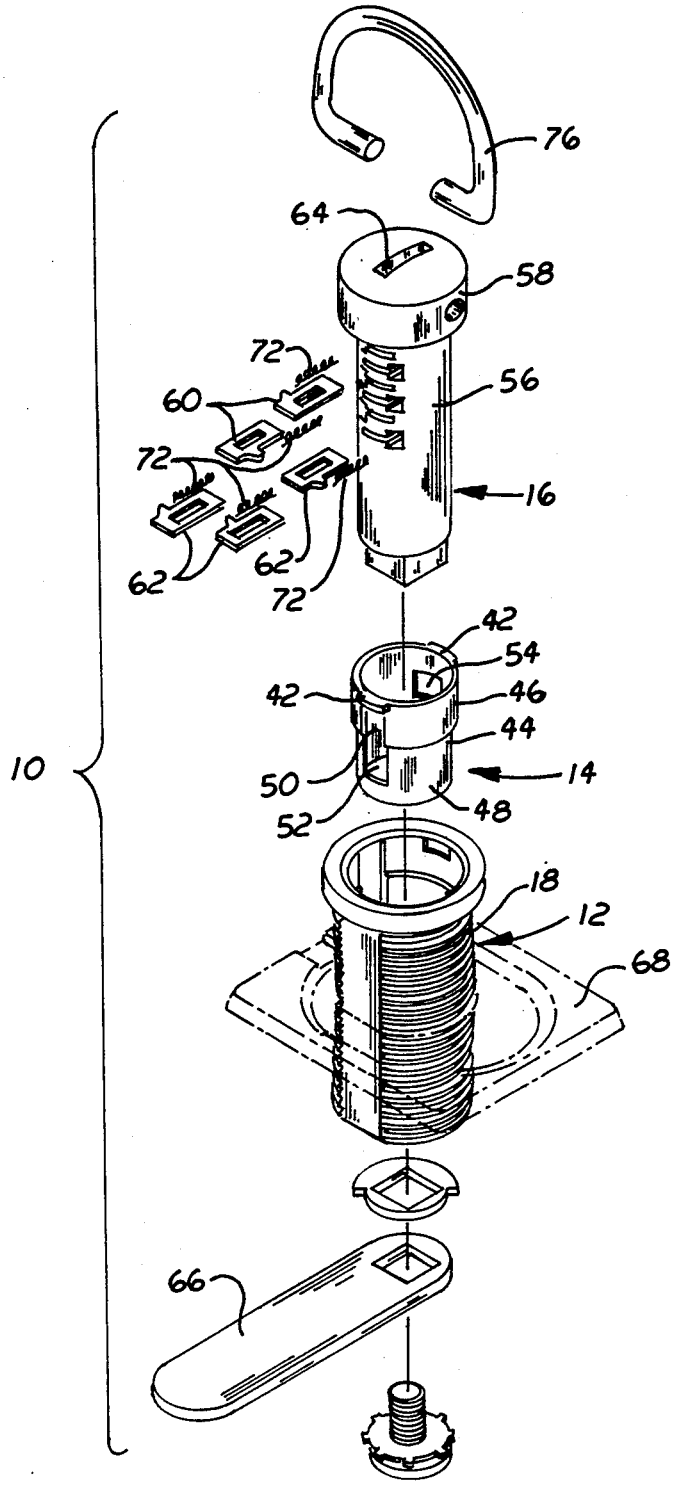
FIG. 1 is an exploded view of the dual function lock/latch device.
Figure 2:
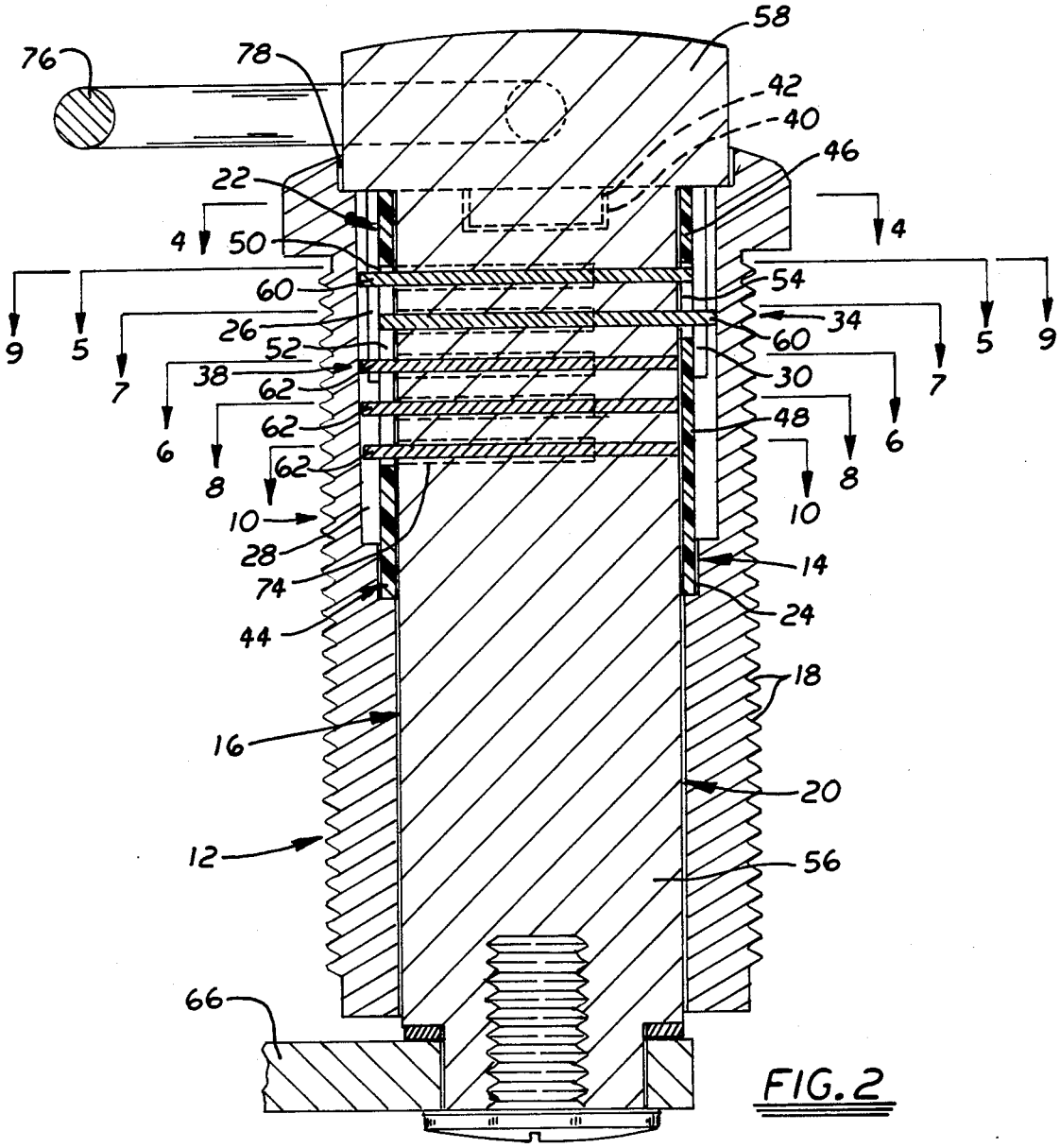
FIG. 2 is a cross-sectional view of the dual function lock/latch device with the left side showing the dual function lock/latch device in the lock configuration and lock/latch position, the the right side showing the dual function lock/latch device in the latch configuration and unlock/unlatch position.

As shown in FIGS. 1 and 2, the present invention relates to a dual function lock/latch device generally indicated as 10 selectively operable in a latch configuration or lock configuration. As best shown in FIG. 1, the dual function lock/latch device 10 comprises an outer housing, intermediate sleeve and inner member generally indicated as 12, 14 and 16 respectively.

As best shown in FIG. 2, the outer housing 12 comprises an externally threaded substantially cylindrical body 18 having a centrally disposed substantially cylindrical bore 20 formed therethrough including an outer and inner substantially cylindrical countersunk regions indicated as 22 and 24 respectively formed in the outer end thereof. A lock spline including an upper sleeve actuator spline portion and a lower lock spline portion indicated as 26 and 28 respectively are formed longitudinally on the inner periphery of the centrally disposed substantially cylindrical bore 20 in the outer and inner substantially cylindrical countersunk regions 22 and 24 respectively. A sleeve actuator spline 30 is formed longitudinally on the inner periphery of the centrally disposed substantially cylindrical bore 20 in the outer substantially cylindrical countersunk region 22.

Figure 6:
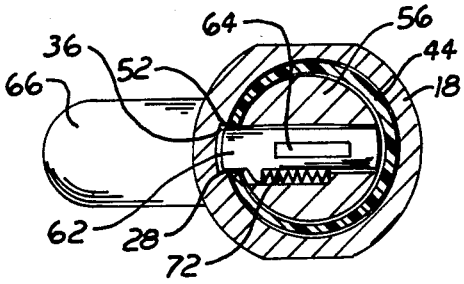
FIG. 6 is a cross-section top view of the dual function lock/latch device taken along line 6—6 of FIG. 2 in the lock configuration and lock/latch position.
Figure 7:
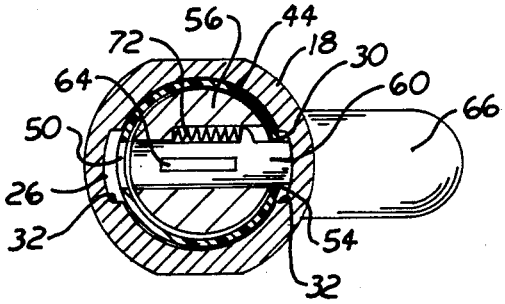
FIG. 7 is a cross-section top view of the dual function lock/latch device taken along line 7—7 of FIG. 2 in the latch configuration and unlock/unlatch position.
Figure 8:
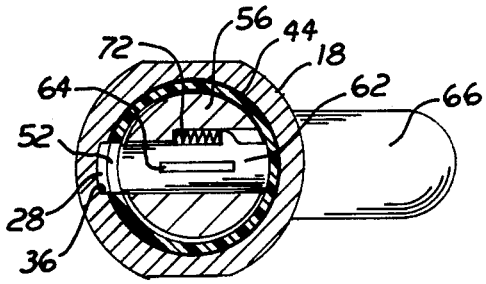
FIG. 8 is a cross-section top view of the dual function lock/latch device taken along line 8—8 of FIG. 2 in the latch configuration and unlock/unlatch position.

As shown in FIGS. 4, 5, 7 and 9, the side walls 32 of the upper sleeve actuator spline portion 26 and sleeve actuator spline 30 are arcuate or contoured to provide clearance of an upper set of sleeve actuator tumblers generally indicated as 34 during rotation of the inner member 16 as described more fully hereinafter. In contrast, as shown in FIGS. 6, 8 and 10, the side walls 36 of the lower lock spline portion 28 are flat to engage a lower set of lock tumblers generally indicated as 38 to prevent rotation of the inner member 16 as described more fully hereinafter.

Figure 4:
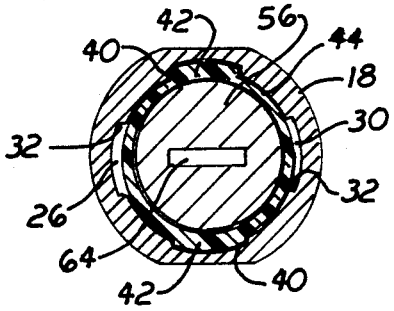
FIG. 4 is a cross-section top view of the dual function lock/latch device taken along line 4—4 of FIG. 2.

As best shown in FIGS. 2 and 4, the outer housing 12 further includes a pair of sleeve acutator detents each indicated as 40 formed on the inner periphery of the centrally disposed substantially cylindrical bore 20 in the outer substantially cylindrical countersunk region 22 to selectively receive a corresponding pair of sleeve detent tabs each indicated as 42 to provide limited rotational resistance between the outer housing 12 and intermediate sleeve 14 as described more fully hereinafter.

As shown in FIGS. 1 and 2, the intermediate sleeve 14 comprises a hollow substantially cylindrical body 44 including an outer enlarged portion and inner reduced portion indicated as 46 and 48 respectively at least partially disposed within the outer substantially cylindrical countersunk region 22 and inner substantially cylindrical countersunk region 24 respectively. A lock slot including an upper sleeve actuator slot portion and a lower lock slot portion indicated as 50 and 52 respectively are formed through the hollow substantially cylindrical body 44 to selectively receive the upper set of sleeve actuator tumblers 34 and lower set of lock tumblers 38 respectively. A sleeve actuator slot 54 is formed through the hollow substantially cylindrical body 44 to selectively receive the sleeve actuator tumblers 34. The corresponding pair of sleeve detent tabs 42 are formed on outer periphery of the outer enlarged portion 46 of the hollow substantially cylindrical body 44.

As shown in FIGS. 1 and 2, the inner member 16 comprises a substantially cylindrical inner body 56 having the upper set of sleeve actuator tumblers 34 and the lower set of lock tumblers 38 retractably disposed longitudinally along the periphery thereof and an enlarged outer end portion 58. The upper set of sleeve actuator tumblers 34 comprises a plurality of sleeve actuator tumblers each indicated as 60 of conventional configuration or structure, while the lower set of lock tumblers 38 comprises a plurality of lock tumblers each indicated as 62 of conventional configuration or structure.

Figure 3:
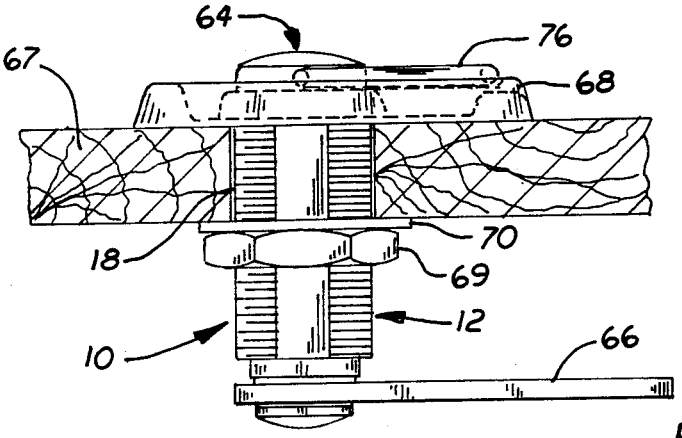
FIG. 3 is a side view of the dual function lock/latch device with a mounting plate and cam lock/latch member.

As shown in FIGS. 1 and 3, a keyway and cam lock/latch member indicated as 64 and 66 respectively are formed on opposite ends of the inner member 16.

In use, the dual function lock/latch device 10 may be installed in any application suitable to a connection tumbler lock. The dual function lock/latch device 10 is mounted to a door, hatch or lid partially shown as 67 by a mounting plate 68, nut 69 and lock washer 70 combination (FIG. 3) such that the cam lock/latch member 66 can selectively engage a stationary element to latch or lock the door, hatch or lid 67.

When in the lock configuration the inner member 16 is locked or secured to the outer housing 12 in the lock/latch position. When the proper key (not shown) is inserted into the keyway 64, the inner member 16 may be rotated relative to the outer housing to unlock/unlatch position. When the key (not shown) is removed in the latch configuration, the inner member 16 and actuator sleeve 14 may be rotated between lock/latch position and unlock/unlatch position. Without the use of the key, the user can thus secure the door hatch or lid or open the door, hatch or lid 67 using a loop or similar structure affixed to the inner member 16.

When in the latch configuration and unlock/unlatch position, the user may insert the key and rotate the inner member 16 to lock/latch position. Upon removal of the key (not shown), the dual function lock/latch device 10 is again in the lock configuration locked in the lock/latch position.

The sequence of operations is best understood with reference to FIGS. 5 through 10.

Figure 5:
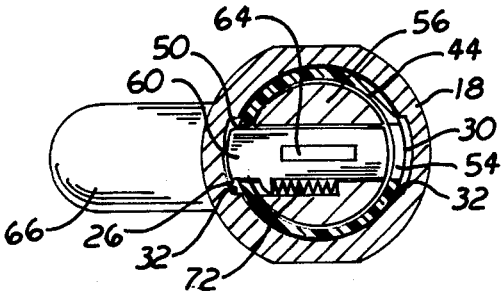
FIG. 5 is a cross-section top view of the dual function lock/latch device taken along line 5—5 of FIG. 2 in the lock configuration and lock/latch position.

FIGS. 5 and 6 show the dual function lock/latch device 10 in the lock configuration and lock/latch position. As shown, the sleeve actuator tumblers 60 extend through the upper sleeve actuator slot portion 50 into the upper sleeve actuator spline position 26 (FIG. 5), while the lock tumblers 62 extend through the lower lock slot portion 52 into the lower lock spline portion 28 (FIG. 6) to lock the inner member 16 relative to the outer housing 12.

Insertion of the key (not shown) into the keyway 64 retracts the sleeve actuator tumblers 60 and lock tumblers 62 against the force of the spring or bias 72 into the perimeter of the inner member 16 into tumbler recesses each indicated as 74 (FIG. 2). This permits rotation of the inner member 16 to the unlock/unlatch position (FIGS. 7 and 8). The sleeve detent tabs 42 are disposed within the sleeve detents 40 to prevent rotation of the intermediate sleeve 14 (FIG. 4).

FIGS. 7 and 8 show the dual function lock/latch device 10 in the latch configuration and unlock/unlatch position. As shown, upon removal of the key (not shown) the sleeve actuator tumblers 60 extend through the sleeve actuator slot 54 (FIG. 7), while the lock tumblers 62 engage the inner surface of the hollow substantially cylindrical body 44 (FIG. 8) to permit rotation of the inner member 16 and intermediate sleeve 14 relative to the outer housing 12 between the unlock-/unlatch position (FIGS. 7 and 8) and lock/latch position (FIGS. 9 and 10).

Figure 9:
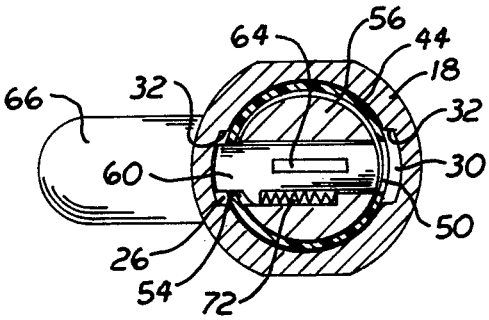
FIG. 9 is a cross-section top view of the dual function lock/latch device taken along line 9—9 of FIG. 2 in the latch configuration and lock/latch position.
Figure 10:
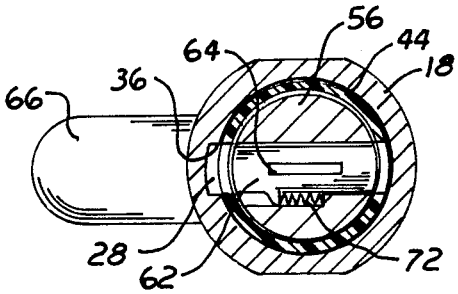
FIG. 10 is a cross-section top view of the dual function lock/latch device taken along line 10—10 of FIG. 2 in the latch configuration and lock/latch position.

FIGS. 9 and 10 show the dual function lock/latch device 10 in the latch configuration and lock/latch position. As shown, the sleeve actuator tumblers 60 extend through the sleeve actuator slot 54 into the sleeve actuator spline portion 26 (FIG. 9), while the lock tumblers 62 are prevented from entering into the lower lock spline portion 28 (FIG. 10). The inner member 16 and intermediate sleeve 14 may then be rotated to the unlock/unlatch position without the use of the key (not shown).

The dual function lock/latch device 10 may be returned from the latch configuration and unlock/unlatch position (FIGS. 7 and 8) to the lock configuration and lock/latch position (FIGS. 5 and 6) by insertion of the key (not shown) retracting the sleeve actuator tumblers 60 into the perimeter of the inner member 16. By rotating the key (not shown), the inner member 16 is returned to the lock/latch position, while the sleeve detents 40 and sleeve detent tabs 42 maintain the intermediate sleeve 14 in the lock/latch position. Upon removal of the key (not shown), the dual function lock/latch device 10 is again in the lock/latch configuration and lock/latch position (FIGS. 5 and 6).

As shown in FIGS. 1 through 3, a marine lift ring assembly or loop 76 may be attached to the inner member 16 for use on door, hatch or lid 67. As shown in FIG. 2, the centrally disposed substantially cylindrical bore 20 may further include an enlarged outer substantially cylindrical countersunk region 78 to receive the lower portion of the enlarged outer end portion 58 of the inner member 16.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A dual function lock/latch device selectively operable in a latch configuration or lock configuration comprising an outer housing having a bore formed therethrough including a lock spline with side walls and sleeve actuator spline with side walls formed about the inner periphery thereof, an inner member having a keyway and cam lock/latch member formed on the outer and inner end portions thereof rotatable between a lock-/latch position and an unlock/unlatch position disposed within the bore with at least one sleeve actuator tumbler and at least one lock tumbler disposed longitudinally along the periphery thereof movable from an extended and retracted position by a key inserted into said keyway, and an intermediate sleeve including a sleeve actuator slot and a lock slot formed therethrough disposed between said inner member and outer housing such that when in said lock configuration and lock/latch position said lock tumbler extends through said lock slot into said lock spline to lock said inner member relative thereto to lock said dual function lock/latch device in said lock/latch position, that when in said lock configuration the insertion of said key into said keyway retracts said lock tumbler to permit rotation of said inner member from said lock/latch position to the unlock/unlatch position and that when in said latch configuration said sleeve actuator tumbler extends through said sleeve actuator slot to permit rotation of the inner member and intermediate sleeve between said lock/latch position and unlock/unlatch position.

2. The dual function lock/latch device of claim 1 wherein said lock spline comprises an upper sleeve actuator spline portion and a lower lock spline portion, said side walls of said upper sleeve actuator spline portion and said side walls of said sleeve actuator spline being arcuate to permit clearance of said sleeve actuator tumbler therewith during rotation of said inner member.

3. The dual function lock/latch device of claim 2 wherein said lock slot comprises an upper sleeve actuator slot portion and a lower lock slot portion, said upper sleeve actuator slot portion aligned with said upper sleeve actuator spline portion said lower lock slot portion aligned with and said lower lock spline portion to receive said sleeve actuator tumbler and said lock tumbler respectively therethrough when said dual function lock/latch device is in said lock configuration and said lock/latch position.

4. The dual function lock/latch device of claim 3 wherein said bore includes an outer and inner countersunk region and said intermediate sleeve includes an outer enlarged portion and and inner reduced portion disposed with said outer countersunk region and inner countersunk region respectively.

5. The dual function lock/latch device of claim 4 wherein said upper sleeve actuator slot portion and said sleeve actuator slot are formed through said outer enlarged portion of said intermediate sleeve and said lower lock slot portion is formed through said inner reduced portion of said intermediate sleeve.

6. The dual function lock/latch device of claim 1 further including a plurality of said lock tumblers.

7. The dual function lock/latch device of claim 6 further including a plurality of sleeve actuator tumblers.

8. The dual function lock/latch device of claim 1 further includes at least one sleeve actuator detent formed in said bore and at least one sleeve actuator detent tab formed on said intermediate sleeve disposed to selectively engage said sleeve actuator detent to limit rotation of said intermediate sleeve to the latch configuration.

9. The dual function lock/latch device of claim 1 wherein said bore comprises a centrally disposed substantially cylindrical bore, said inner member comprises a substantially cylindrical inner body and said intermediate sleeve comprises a hollow substantially body.

10. The dual function lock/latch device of claim 9 wherein said lock spline comprises an upper sleeve actuator spline portion and a lower lock spline portion, said side walls of said upper sleeve actuator spline portion and said side walls of said sleeve actuator spline being arcuate to permit clearance of said sleeve actuator tumbler therewith during rotation of said inner member.

11. The dual function lock/latch device of claim 10 wherein said lock slot comprises an upper sleeve actuator slot portion and a lower lock slot portion, said upper sleeve actuator slot portion aligned with said upper sleeve actuator spline portion said lower lock slot portion aligned with and said lower lock spline portion to receive said sleeve actuator tumbler and said lock tumbler respectively therethrough when said dual function lock/latch device is in said lock configuration and said lock/latch position.

12. The dual function lock/latch device of claim 11 wherein said bore includes an outer and inner countersunk region and said intermediate sleeve includes an outer enlarged portion and and inner reduced portion disposed with said outer countersunk region and inner countersunk region respectively.

13. The dual function lock/latch device of claim 12 wherein said upper sleeve actuator slot portion and said sleeve actuator slot are formed through said outer enlarged portion of said intermediate sleeve and said lower lock slot portion is formed through said inner reduced portion of said intermediate sleeve.

14. The dual function lock/latch device of claim 9 further including a plurality of said lock tumblers.

15. The dual function lock/latch device of claim 14 further including a plurality of sleeve actuator tumblers.

16. The dual function lock/latch device of claim 9 further includes at least one sleeve actuator detent formed in said bore and at least one sleeve actuator detent tab formed on said intermediate sleeve disposed to selectively engage said sleeve actuator detent to limit rotation of said intermediate sleeve to the latch configuration.

* * * * *